US008522587B2

(12) United States Patent
Cha

(10) Patent No.: US 8,522,587 B2
(45) Date of Patent: Sep. 3, 2013

(54) JOINT JIG OF SPIRAL DUCT MANUFACTURING APPARATUS

(75) Inventor: Kyu-Seok Cha, Hwaseong (KR)

(73) Assignee: Jinwoong Technologies Co., Ltd., Hwaseong-Shi, Kyonggi-Do (KR)

( * ) Notice: Subject to any disclaimer, the term of this patent is extended or adjusted under 35 U.S.C. 154(b) by 474 days.

(21) Appl. No.: 12/993,691

(22) PCT Filed: May 22, 2008

(86) PCT No.: PCT/KR2008/002851
§ 371 (c)(1),
(2), (4) Date: Nov. 19, 2010

(87) PCT Pub. No.: WO2009/142342
PCT Pub. Date: Nov. 26, 2009

(65) Prior Publication Data

US 2011/0072650 A1 Mar. 31, 2011

(51) Int. Cl.
*B21C 37/12* (2006.01)

(52) U.S. Cl.
USPC ..... 72/49

(58) Field of Classification Search
USPC ..... 72/48, 49, 50, 127, 146, 367.1, 368; 29/509, 890.149
See application file for complete search history.

(56) References Cited

U.S. PATENT DOCUMENTS 3,858,421 A * 1/1975 Wood ..... 72/50
3,940,962 A * 3/1976 Davis ..... 72/50
4,616,495 A * 10/1986 Menzel ..... 72/49
4,704,885 A * 11/1987 Nakajima ..... 72/50

(Continued)

FOREIGN PATENT DOCUMENTS

KR 2019940006932 Y1 10/1994
KR 20-0232329 Y1 9/2001

(Continued)

OTHER PUBLICATIONS

International Search Report of International Application No. PCT/KR2008/002851, dated Feb. 11, 2009.

*Primary Examiner* — Edward Tolan
(74) *Attorney, Agent, or Firm* — Kile Park Reed & Houtteman PLLC

(57) ABSTRACT

Provided is a joint jig of a spiral duct manufacturing apparatus including an uncoiler around which a metal plate member is wound; a wave bending device which cuts the metal plate member supplied from the uncoiler into a straight line and waves and forms a single folded portion and a double folded portion at both edges of the cut metal plate member; a ball caster which bends the projecting wave portions of the metal plate member supplied from the wave bending device upward; a pair of transfer rollers which transfer the metal plate member supplied through the ball caster; upper and lower pressing rollers which are installed adjacent to each other in the vertical direction and press the single folded portion and the double folded portion of the metal plate member; and upper and lower cutters which cut a spiral duct pressed by the upper and lower pressing rollers. The joint jig is installed on the front surface of the upper and lower pressing rollers so as to form the metal plate member, transferred by the transfer rollers, into a cylindrical shape. As the joint jig is installed in the spiral duct manufacturing apparatus, an elbow can be easily manufactured. When the elbow is manufactured, the elbow can be freely moved. Therefore, there is no trouble in forming the elbow.

6 Claims, 7 Drawing Sheets

(56) References Cited

U.S. PATENT DOCUMENTS

| | | | | |
|---|---|---|---|---|
| 5,014,424 | A | 5/1991 | Takasugi | |
| 6,003,220 | A * | 12/1999 | Lennartsson | 29/509 |
| 6,701,762 | B2 * | 3/2004 | Diaz Coello | 72/49 |
| 7,730,754 | B2 * | 6/2010 | Cha et al. | 72/50 |

FOREIGN PATENT DOCUMENTS

| | | | |
|---|---|---|---|
| KR | 100599078 | B1 | 7/2006 |
| KR | 100646808 | B1 | 11/2006 |
| KR | 100834795 | B1 | 6/2008 |

* cited by examiner

JOINT JIG OF SPIRAL DUCT MANUFACTURING APPARATUS

TECHNICAL FIELD

The present invention relates to a joint jig of a spiral duct manufacturing apparatus, and more specifically, to a joint jig of a spiral duct manufacturing apparatus which is installed in a seaming device for forming a spiral duct to form a metal plate member into a cylindrical shape.

BACKGROUND ART

In general, spiral ducts are used in air handing units, pipelines for transferring particles and so on.

Normally, an apparatus for manufacturing the spiral ducts has a plurality of pressing rollers provided therein. While a thin metal plate member wound around a reel passes through the plurality of pressing rollers, both edges of the metal plate member are bent in the reverse direction.

As the metal plate member is pressed by the pressing rollers after both of the bent edges thereof are coupled to each other, the metal plate member is formed into a cylindrical shape. In this case, the metal plate member is guided while being supported by a plurality of guide rods installed in a circumferential direction on the cylinder.

As the metal plate member is connected continuously, a spiral duct is formed. When the spiral duct is formed to have a proper length, the spiral duct is cut by a circular cutter.

Such a representative spiral duct manufacturing apparatus is disclosed in Korean Unexamined Utility Model No. 1999-5329 (hereinafter, referred to as 'the related art'). Referring to FIGS. 1A to 1F, the construction of the spiral duct manufacturing apparatus will be described.

As shown in the drawings, the spiral duct manufacturing apparatus according to the related art carries a metal plate member 18, supplied from a reel stand 19, through a plurality of bending rollers 21 arranged in plural lines so as to bend both ends of the metal plate member 18. Then, both ends of the metal plate member 18 are pressed by pressing rollers 31 so as to form a cylindrical duct, and the duct is cut by a circular saw blade 42. At the exit side of the bending rollers 21, a transfer unit 2 including a pair of driving rollers 22 is installed on a first table 11.

The driving rollers 22 are composed of a lower driving roller 24 which is connected to a cylinder 25 so as to operate in the vertical direction and an upper driving roller 23 which is disposed above the lower driving roller 24 and receives power from a driving motor 26.

On a second table 12, a forming unit 3 is installed, including a bolt 32 which adjusts a pressing force for coupling the bent portions 18*a* and 18*b* of the metal plate member 18 supplied from the transfer unit 2, a pair of pressing rollers 31 to which the distal end of a lever 33 having the bolt 32 fastened thereto is coupled, and a circular frame 34 which guides a duct which is formed in a cylinder shape while passing through the pressing rollers 31.

The circular frame 34 has a spiral guide groove 35 formed on the inner circumferential surface thereof, the spiral guide groove 35 serving to guide the duct.

Under the forming unit 3, a cutting unit 4 is installed on the second table 12. The cutting unit 4 includes an operating plate 41 which slides on the second table 12, a bracket 46 which is installed on the distal end of the operating plate 41 so as to connect the circular saw blade 42, a motor 43 for rotating the circular saw blade 42, and a cylinder 44 which adjusts the height of the circular saw blade 42.

On the second table 12, a cylinder 47 for moving and returning the cutting unit 4 is installed. The first and second tables 11 and 12 are connected through a guide plate 5.

In the spiral duct manufacturing apparatus according to the related art, manufacturing the circular frame 34 having the guide groove 35 consumes a great deal of operation time. Further, since the spiral duct manufacturing apparatus includes the plurality of motors 26 and 43 and the cylinders 44 and 47, a manufacturing cost increases.

Further, the spiral duct manufacturing apparatus can manufacture a spiral duct formed in a straight line, but cannot manufacture an elbow-shaped spiral duct.

DISCLOSURE

Technical Problem

In order to solve the foregoing and/or other problems, it is an objective of the present invention to provide a joint jig of a spiral duct manufacturing apparatus, which can manufacture an elbow formed into a spiral duct.

Technical Solution

In one aspect, the invention is directed to a joint jig of a spiral duct manufacturing apparatus, the joint jig comprising: a plurality of divided pieces forming a circle which is partially opened; a plurality of bearings that are fixed between the respective divided pieces; a plurality of length adjusting bars that are installed on projections which extend and project from both sides of the divided pieces; and a plurality of guide plates that are bent so as to be in contact with inner races of the divided pieces at one surface and are fixed in such a manner that a metal plate member passes through the guide plates. The metal plate member in which a straight line and waves are consecutively formed is formed into a cylindrical shape.

DESCRIPTION OF DRAWINGS

The foregoing and other objects, features and advantages of the invention will be apparent from the more particular description of preferred embodiments of the invention, as illustrated in the accompanying drawings. The drawings are not necessarily to scale, emphasis instead being placed upon illustrating the principles of the invention.

BEST MODE

Hereinafter, exemplary embodiments of the present invention will be described in detail with reference to FIGS. 2 to 6.

Figure 1A:
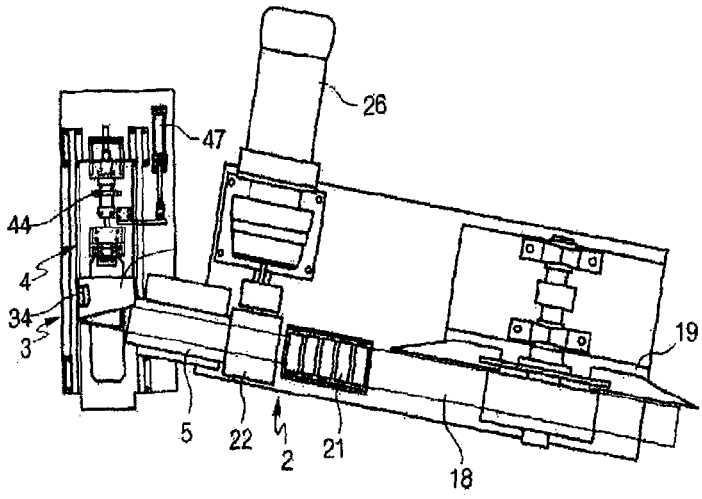
FIG. 1A is a cross-sectional view of a spiral duct manufacturing apparatus according to the related art.
Figure 1B:
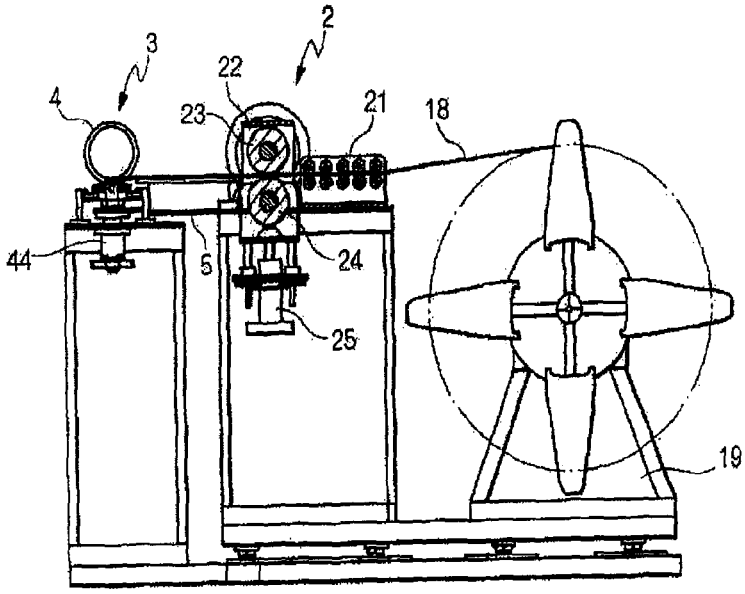
FIG. 1B is a front view of the spiral duct manufacturing apparatus which is partially cut.
Figure 1C:
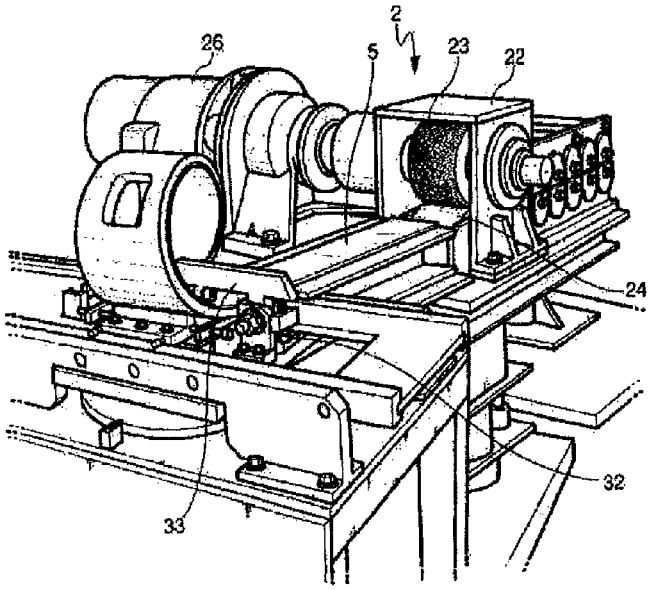
FIG. 1C is a perspective view of a forming unit.
Figure 1D:
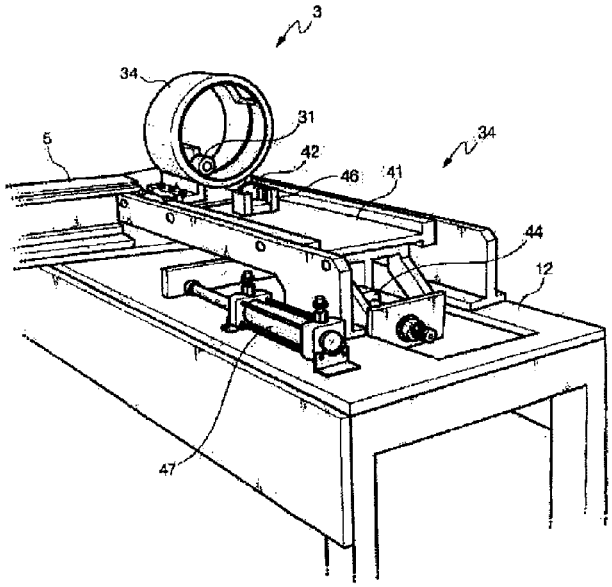
FIG. 1D is a perspective view of a cutting unit.
Figure 1E:
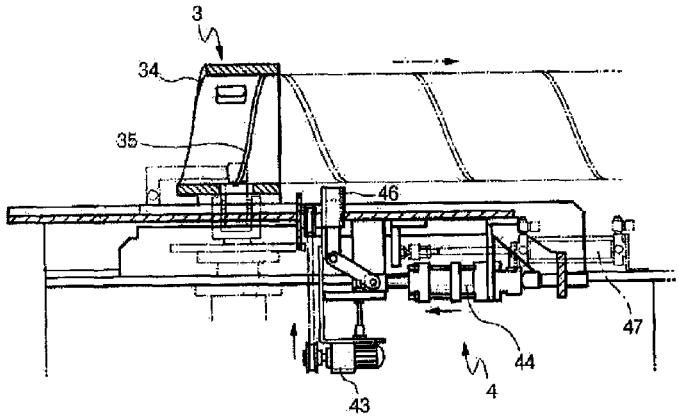
FIG. 1E is a side view illustrating an operation state.
Figure 1F:
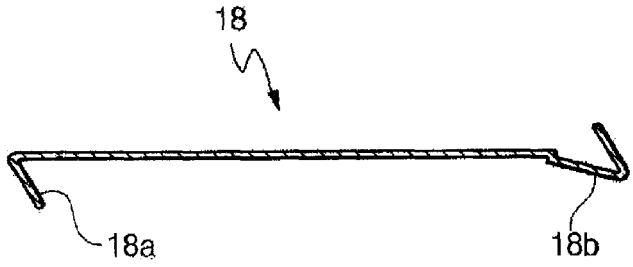
FIG. 1F illustrates a metal plate member.
Figure 2:
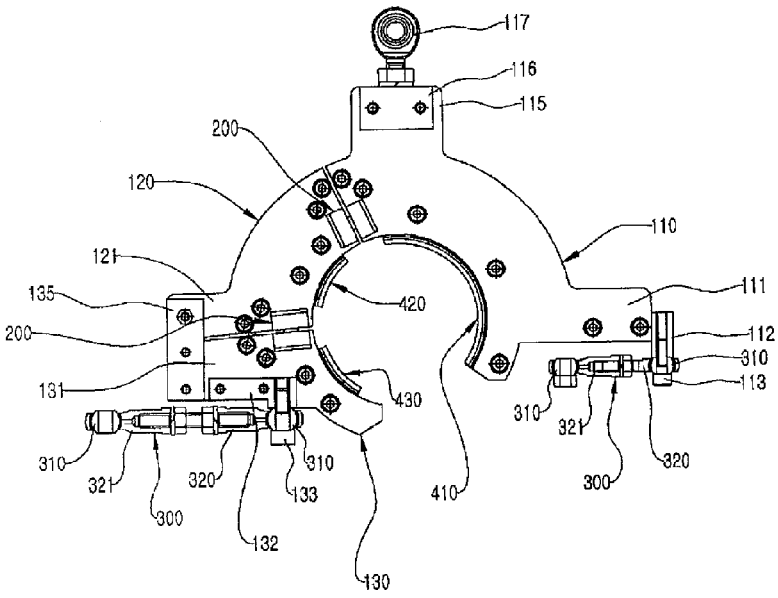
FIG. 2 is a front view of a joint jig according to the present invention.
Figure 3:
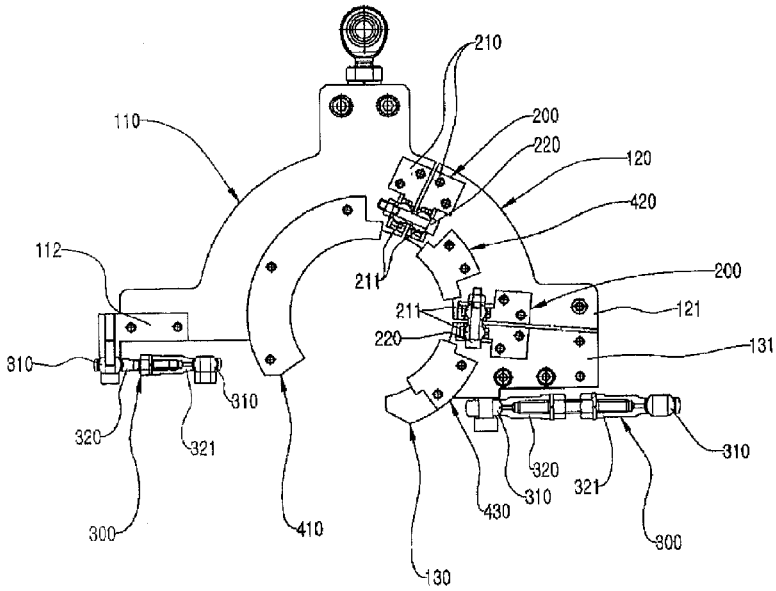
FIG. 3 is a rear view of the joint jig according to the present invention.
Figure 4:
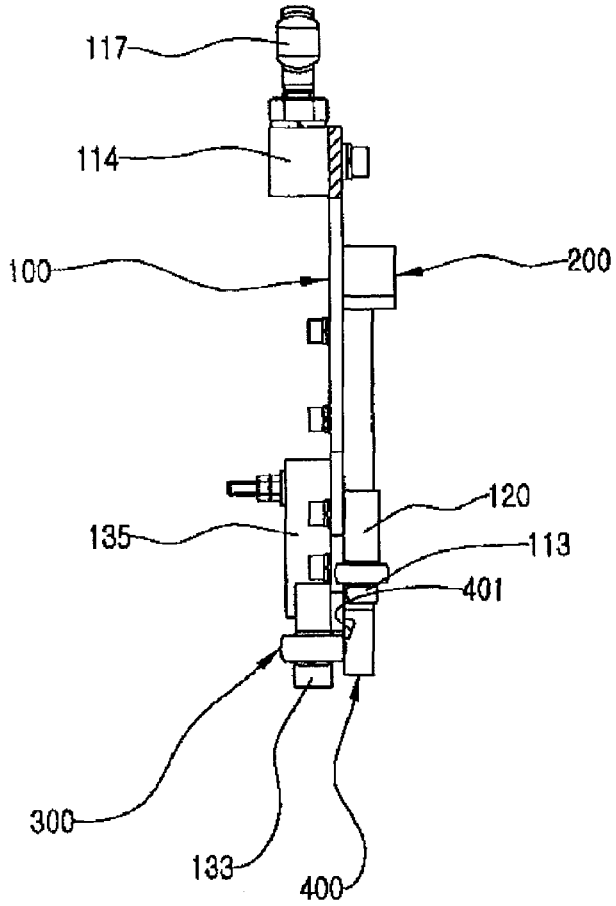
FIG. 4 is a side view of the joint jig according to the present invention.
Figure 5:
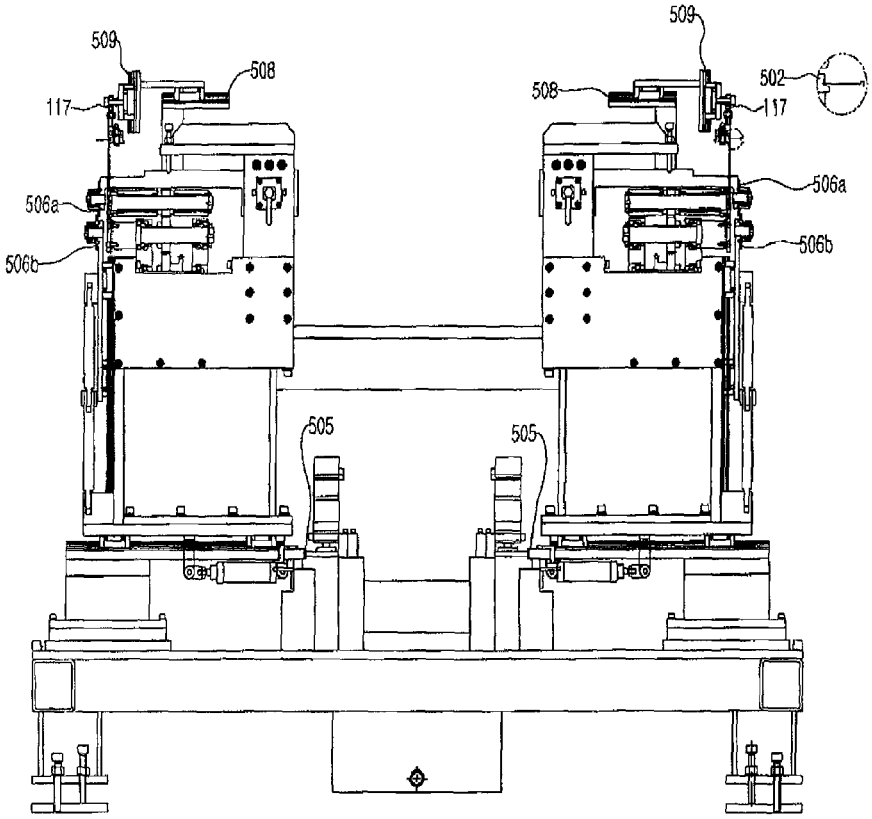
FIG. 5 is a front view of a seaming device in which the joint jig according to the present invention is installed.
Figure 6:
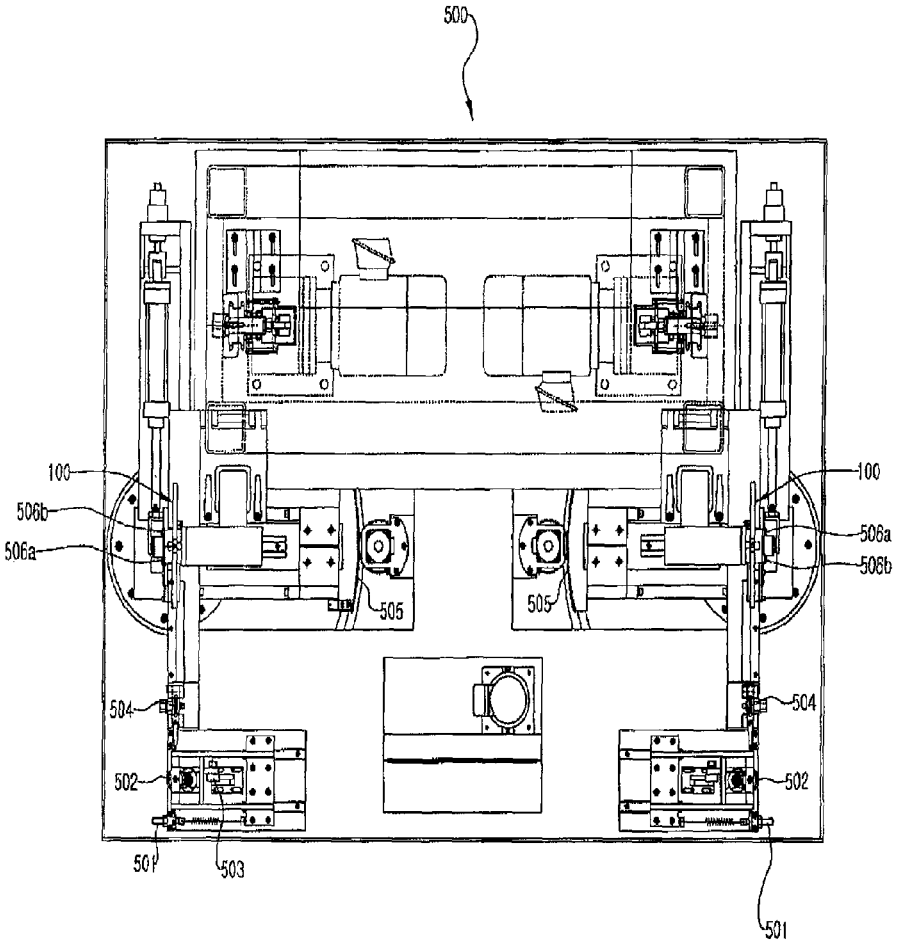
FIG. 6 is a plan view of the seaming device in which the joint jig according to the present invention is installed.

FIG. 2 is a front view of a joint jig according to the present invention. FIG. 3 is a rear view of the joint jig according to the present invention. FIG. 4 is a side view of the joint jig according to the present invention. FIG. 5 is a front view of a seaming device in which the joint jig according to the present invention is installed. FIG. 6 is a plan view of the seaming device in which the joint jig according to the present invention is installed.

As shown in FIGS. 2 to 6, the joint jig according to the present invention includes a plurality of divided pieces 100 having an inner race formed thereon, a plurality of bearings 200 which are coupled between the respective divided pieces 100 such that the divided pieces 100 are rocked, a plurality of length adjusting bars 300 which are installed on the left, right, and upper sides of the divided pieces 100, and a plurality of guide plates 400 which are installed on the inner race of the divided pieces 100 so as to guide the movement of a metal plate member.

The plurality of divided pieces 100 are coupled to each other so as to form a circular arc of which a lower portion is partially opened.

As shown in FIGS. 2 and 3, the divided pieces 100 are composed of first to third divided pieces 110 to 130 which are divided at different angles from each other. The first divided piece 110 is formed in a circular arc of which the center angle is set to more than about 90 degrees, and the second and third divided pieces 120 and 130 are formed in a circular arc of which the center angle is set to about 70-80 degrees.

The first divided piece 110 has a side projection 111 formed in one side thereof, the side projection 111 extending and projecting outward.

The side projection 111 has a first fixing plate 112 installed thereon, and a first bolt 113 is fastened to the first fixing plate 112 through a through-hole formed in the first plate 112. Further, a length adjusting bar 300 is installed on the bolt 113.

The first divided piece 110 has an upper projection 115 formed in the upper portion thereof, the upper projection 115 extending and projecting upward. The upper projection 115 has a second fixing plate 112 installed thereon, the second fixing plate 112 having an upper fixing member 117 installed thereon. The fixing member 117 serves to stably fix the first divided piece 110 to a seaming device which will be described below.

The second divided piece 120 is disposed between the first and third divided pieces 110 and 130. The second divided piece 120 has a side projection 121 formed in one side thereof, the side projection 121 extending and projecting outward. The bearing 200 is coupled between the first and second divided pieces 110 and 120.

The third divided piece 130 has a side projection 131 formed in one side thereof, the side projection 131 extending and projecting outward. The side projection 131 has a third fixing plate 132 coupled thereto, and a second bolt 133 is fastened to the third fixing plate 132. Another length adjusting bar 300 is coupled to the second bolt 133.

The second and third divided pieces 120 and 130 are coupled in such a manner that the side projections 121 and 131 are set adjacent to each other. The outer ends of the side projections 121 and 131 are coupled to each other by a vertical fixing plate 135. Between the first and second divided pieces 110 and 120 and between the second and third divided pieces 120 and 130, the bearings 200 are respectively coupled.

As shown in FIG. 3, each of the bearings 200 has a self-aligning bearing 211 built in a fixed bearing outer-race body 210.

Further, a bolt 220 for connecting two divided pieces 110 and 120 is fastened to the self-aligning bearing 211 so as to pass through the self-aligning bearing 211.

As such, the bearing 200 having the self-aligning bearing 211 built in the outer-race body 210 is coupled between the second and third divided pieces 120 and 130.

The length adjusting bars 300 are coupled to the side projection 111 of the first divided piece 110 and the side projection 131 of the third divided piece 130, respectively.

One end of the length adjusting bar 300 coupled to the side projection 111 of the first divided piece 110 is fixed to the first bolt 113 of the first fixing plate 112, and the other end thereof is fixed to a spiral duct manufacturing apparatus through a bolt (not shown). One end of the length adjusting bar 300 coupled to the side projection 131 of the third divided piece 130 is fixed to the second bolt 133 of the third fixing plate 132, and the other end thereof is fixed to the spiral duct manufacturing apparatus through a bolt (not shown).

Between the one end of the length adjusting bar 300 and the first bolt 113 and between the one end of the length adjusting bar 300 and the second bolt 133, self aligning bearings 310 are respectively coupled. Between the other end of the length adjusting bar 300 and the bolt, the self aligning bearing 310 is coupled.

Each of the length adjusting bars 300 includes a first bar 320 coupled to the first or second bolt 113 or 133 and a second bar 321 fastened to the first bar 320.

Alternatively, a stud bolt may be interposed between the first and second bars 320 and 321 such that the first and second bars 320 and 321 are fastened to both sides of the stud bolt.

Further, a plurality of guide plates 400 are fixed to the respective inner races of the first to third divided pieces 110 to 130. The guide plates 400 are composed of a first guide plate 410 fixed to the first divided piece 110, a second guide plate 420 fixed to the second divided piece 120, and a third guide plate 430 fixed to the third divided piece 130.

The guide plates 400 are formed in a bent shape so as to be in contact with the inner races of the divided pieces 100, and have a concave groove portion 401 formed on the inner surfaces thereof, through which a single folded portion of the metal plate member passes. The groove portion 401 is formed in a triangle shape.

The joint jig constructed in such a manner is installed on a spiral duct manufacturing apparatus which is shown in FIGS. 5 and 6. Hereinafter, the construction of the spiral duct manufacturing apparatus will be described briefly.

As shown in the drawings, the spiral duct manufacturing apparatus 500 includes a wave bending device (not shown) which cuts and bends the metal plate member supplied from an uncoiler (not shown).

The wave bending device cuts one side of a belt-shaped metal plate member with a predetermined width such that a straight line and waves are formed, and then forms a double folded portion and a single folded portion at both edges of the metal plate member, respectively.

The spiral duct manufacturing apparatus 500 includes a detection sensor 501 which detects the projecting wave portions of the supplied metal plate member, a ball caster 502 composed of a pair of upper and lower ball casters which bend the projecting wave portions of the metal plate member upward, and a cam 503 which is provided in one side of the ball caster 502 and is moved along an inclined plate.

Further, the spiral duct manufacturing apparatus 500 includes a pair of transfer rollers 504 which transfer the metal plate member, a rotating device 505 which rotates a frame by a predetermined angle, and the joint jig provided on the rotating device 505.

In front of the joint jig according to the present invention, upper and lower cutters 506*a* and 506*b* are installed. The upper and lower cutters 506*a* and 506*b* are rotated by the rotating device 505. The upper cutter 506*a* is lifted upward by a first cylinder (not shown), and the second cutter 506*b* is lifted and lowered along a rail by a second cylinder (not shown).

The spiral duct manufacturing apparatus further includes a horizontal guide rail 508 which is horizontally moved. The horizontal guide rail 508 has a vertical guide rail 509 installed at the distal end thereof, the vertical guide rail 509 being vertically moved.

The joint jig according to the present invention is installed under the vertical guide rail 509. More specifically, the upper fixing member 117 of the joint jig is installed under the vertical guide rail 509.

The two length adjusting bars 300 are fixed to the frame.

The joint jig according to the present invention includes upper and lower pressing rollers (not shown) which press the single folded portion and the double folded portion of the metal plate member such that the metal plate member is formed into a spiral duct.

The metal plate member cut by the wave bending device is formed into a cylindrical shape through the detection sensor 501, the ball caster 502, and the joint jig. In such a state, the metal plate member is installed in such a manner that the single folded portion thereof is inserted between the divided piece 100 of the joint jig and the guide plate 400.

When the spiral duct manufacturing apparatus having the metal plate member installed therein is driven, the metal plate member wound around the uncoiler is continuously supplied by the transfer rollers 504. Then, when the projecting wave portions of the metal plate member enter, the ball caster 502 is retracted.

Accordingly, the cam 503 is lifted along an inclined surface, and the supplied metal plate member reaches the joint jig in a state where the metal plate member is bent upward.

At this time, the metal plate member is transferred in a state where the single folded portion thereof is inserted between the divided piece 100 of the joint jig and the groove portion 401 of the guide plate 410, and the single folded portion and the double folded portion of the metal plate member are pressed by the upper and lower pressing rollers (not shown).

Further, as the metal plate member is pressed by the upper and lower pressing rollers, a spiral duct is formed. Then, the spiral duct is cut by the upper and lower cutters 506*a* and 506*b*.

As such, a cylindrical spiral duct elbow is formed by the joint jig according to the present invention. When the spiral duct elbow is formed, the divided pieces 100 of the joint jig are systematically moved through the bearings 200 and the length adjusting bars 300.

That is, as the spiral duct elbow is formed, the previously formed elbow is rotated and freely moved.

As the elbow is moved and rotated, the divided pieces 110 to 130 of the joint jig are moved through the bearings 200.

At this time, the respective divided pieces 100 to 130 are moved within a displacement where the self aligning bearings 211 are moved. The first and third divided pieces 110 and 130 are moved as much as the displacement of the self aligning bearings 310 installed in the length adjusting bars 300.

While the present invention has been described with reference to exemplary embodiments thereof, it will be understood by those skilled in the art that various changes and modifications in form and detail may be made therein without departing from the scope of the present invention as defined by the following claims.

In particular, the wave bending device and so on excluding the joint jig may be substituted with other devices, and the detection sensor 501, the ball caster 502, and the cam 503 may be omitted.

INDUSTRIAL APPLICABILITY

As the joint jig is installed on the spiral duct manufacturing apparatus, the elbow can be easily manufactured. When the elbow is manufactured, the elbow can be freely moved. Therefore, there is no trouble in forming the elbow.

The invention claimed is:

1. A joint jig of a spiral duct manufacturing apparatus, comprising:

a plurality of divided pieces forming a circle which is partially opened;

a plurality of bearings that are fixed between the respective divided pieces;

a plurality of length adjusting bars that are installed on projections which extend and project from both sides of the divided pieces; and a plurality of guide plates that are bent to be in contact with inner races of the divided pieces at one surface and are fixed in such a manner that a metal plate member passes through the guide plates, wherein the metal plate member in which a straight line and waves are consecutively formed is formed into a cylindrical shape.

2. The joint jig according to claim 1, wherein the respective divided pieces have different circular arc shapes from each other.

3. The joint jig according to claim 2, wherein the bearings have outer race bodies fixed to the respective divided pieces, and the outer race bodies have a self aligning bearing built therein such that the divided pieces can freely move, the self aligning bearing being installed through a bolt.

4. The joint jig according to claim 3, wherein the guide plates have a groove portion formed in a triangle shape such that a single folded portion of the metal plate member passes through the groove portion.

5. The joint jig according to claim 4, wherein the divided pieces are composed of a first divided piece formed in a circular arc shape and second and third divided pieces formed in a circular arc shape of which the center angle is smaller than that of the first divided piece, the first divided piece has a side projection extending and projecting in the lateral direction and an upper projection extending and projecting upward, and the second and third divided pieces have a side projection extending and projecting in the lateral direction.

6. The joint jig according to claim 5, wherein self aligning bearings are coupled to both ends of the length adjusting bar, respectively, such that the divided pieces freely move.

* * * * *